United States Patent [19]

Herder

[11] Patent Number: 4,783,178

[45] **Date of Patent: * Nov. 8, 1988**

[54] METHOD OF MANUFACTURING A WEB OF PLASTIC BAGS

[75] Inventor: Kornelis Herder, Goor, Netherlands

[73] Assignee: Wavin, bv, Zwolle, Netherlands

[ * ] Notice: The portion of the term of this patent subsequent to Dec. 24, 2002 has been disclaimed.

[21] Appl. No.: 13,031

[22] Filed: Feb. 10, 1987

Related U.S. Application Data

[60] Continuation of Ser. No. 778,437, Sep. 20, 1985, which is a division of Ser. No. 381,228, May 25, 1982, Pat. No. 4,561,107, which is a continuation of Ser. No. 148,016, May 8, 1980, abandoned.

[30] Foreign Application Priority Data

May 11, 1979 [NL] Netherlands ..... 7903733

[51] Int. Cl.[4] ..... B65D 33/00

[52] U.S. Cl. ..... 383/120; 383/121

[58] Field of Search ..... 383/121, 120

[56] References Cited

U.S. PATENT DOCUMENTS

| | | | |
|---|---|---|---|
| 3,143,277 | 8/1964 | La Fleur | 383/120 |
| 3,254,828 | 6/1966 | Lerner | 383/121 |
| 3,277,798 | 10/1966 | Krauss | 493/232 |
| 3,395,622 | 8/1968 | Kugler | 493/196 |
| 3,548,722 | 12/1970 | Jones et al. | 493/196 |
| 3,555,974 | 1/1971 | Davis, Jr. | 493/229 |
| 3,750,937 | 8/1973 | Goodwin | 383/122 |
| 3,994,209 | 11/1976 | Jacob | 493/194 |
| 4,027,455 | 6/1977 | Rausing et al. | 493/194 |
| 4,055,109 | 10/1977 | Kan | 493/232 |
| 4,561,107 | 12/1985 | Herder | 383/37 |

FOREIGN PATENT DOCUMENTS

| | | | |
|---|---|---|---|
| 1250731 | 9/1967 | Fed. Rep. of Germany | 493/213 |
| 2548091 | 6/1976 | Fed. Rep. of Germany | 493/213 |
| 7800295 | 10/1977 | Netherlands . | |

*Primary Examiner*—Stephen P. Garbe

*Attorney, Agent, or Firm*—A. Robert Theibault

[57] ABSTRACT

A web of interconnected plastic bags with gusset folds. Each bag is provided with first fold part seals (8, 9, 10, 11) and with second fold part seals (13, 14, 15, 16). Additional seals (36) extend parallel to fold edges of the foil and are connected with subsequent first and second fold part seals. The additional seals (30) are in the region between inner (4, 4a) and other (2, 3 and 2a, 3a) fold edges.

6 Claims, 1 Drawing Sheet

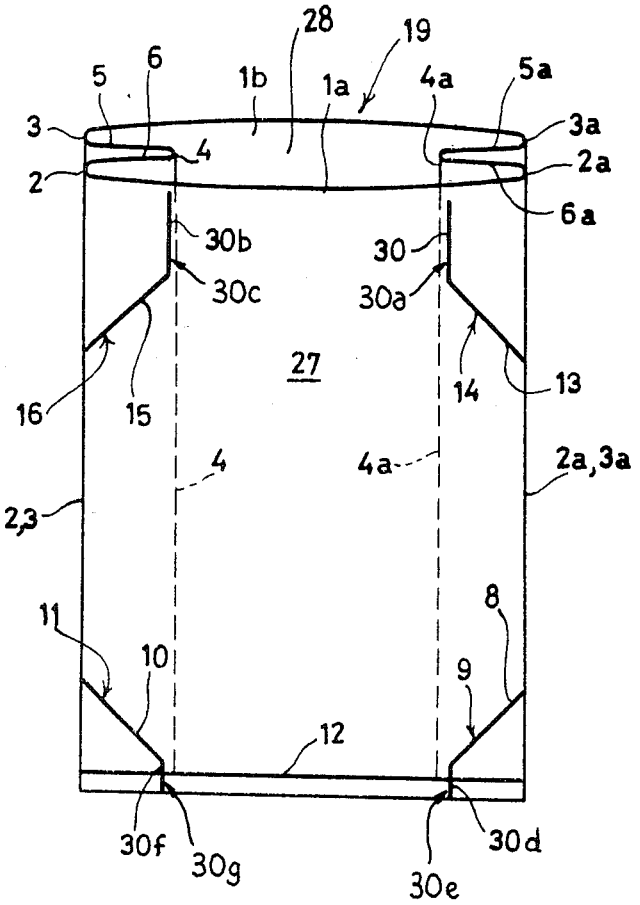
28
19
5
6
1b
1a
4a
5a
3
3a
4
2
2a
6a
30b
30
30c
30a
27
16
15
14
13
4
4a
2a,3a
2,3
11
8
10
9
12
30f
30g
30e
30d

METHOD OF MANUFACTURING A WEB OF PLASTIC BAGS

This application is a continuation of application Ser. No. 778,437, filed Sept. 20, 1985 which is a division of Ser. No. 381,228, filed May 25, 1982 (now U.S. Pat. No. 4,561,107), which is a continuation of Ser. No. 148,016, filed May 8, 1980, now abandoned.

BACKGROUND OF THE INVENTION

1. Field of the Invention

The present invention relates to bag with longitudinal gusset folds, at least comprising a central and two outer longitudinal gusset fold edges which bound a first and a second gusset fold part, by providing a continuously supplied tubular plastic foil by heatsealing with a first transverse bottom seal which extends across the entire width of the tubular foil and moving the tubular foil over a predetermined distance to another sealing position.

2. Description of the Prior Art

A bag of this type is known in the prior art. In the prior art methods the first transverse bottom seal is produced by heatsealing the various different foil layers across the entire width of the bag after having applied lower and upper fold part seals slopingly extending with respect to one another, preferably under an angle of 45°, at both ends of the bag.

The first fold part seals contact the first transverse bottom seal so that a filled bag can be given a block shape at the bottom side. The second fold part seals likewise form, together with a final heatseal to be applied, a block bottom, thus causing a filled bag to have a block shape at either side.

This bag represents the disadvantage that in the filling procedure of the bag filler material to be packed in such a bag is able to penetrate in the pockets existing between the upper fold part seals and the outer longitudinal gusset fold edges. Of course this filler material will impair the quality of the seal to be applied for closing the bag, the more so as in the gusset fold region four foil layers have to be heatsealed to each other and in the central part only two.

Of course one might position the filling mouth of the filling machine at a lower level in the bag but this decreases the filling capacity of a bag.

Furthermore the pockets cannot be removed as these pockets are necessary for seizing a bag during the filling procedure.

The additional seals should be close to the inner gusset fold edges in order to obtain an improved closing seal. If the additional seal would be far from the inner gusset fold edge much filler material would be present between the inner surfaces of the outer foil layers and opposite gusset fold part.

SUMMARY OF THE INVENTION

In view of the foregoing factors and conditions of the prior art it is a primary object of the present invention to provide a bag over-coming these drawbacks and allowing a more simple filling and closing of the bag.

According to the present invention this aim is attained by a valve free plastic bag.

It has appeared that in this manner a transverse closing seal over the whole width of the bag can be obtained of a much better quality.

A preferred embodiment of the present invention comprises the following steps:

a. At both sides of the tubular foil, two lower fold part seals are formed, whereby each lower fold part seal always connects an outer foil layer with an opposite gusset fold part.

b. At a predetermined distance from said lower fold part seals always at least two upper fold part seals are formed at both sides of the tubular foil, which upper fold part seals connect an outer foil layer part with the opposite gusset fold part.

c. lower and upper fold part seals are formed between the central and outer longitudinal fold part seals, in the direction of the nearest bag end.

d. The lower fold part seals or their extensions are formed to intersect the first transverse bottom seal, substantially in the area near the intersection of a first transverse bottom seal with the central longitudinal gusset fold edges.

e. Forming transverse bottom fold part seals, and f. Forming said first first transverse seal after said lower and upper fold part seals have passed the sealing zone for forming the first transverse bottom seal.

The features of the present invention which are believed to be novel are set forth with particularity in the appended claims.

Other claims and many of the attendant advantages will be more readily appreciated as the same becomes better understood by reference to the following detailed description and considered in connection with the accompanying drawings in which like reference symbols designate like parts throughout the figures.

DESCRIPTION OF THE DRAWINGS

The single FIGURE of drawing is a front view of a single bag constructed in accordance with the present invention.

DESCRIPTION OF A PREFERRED EMBODIMENT

The plastic bag 27, is a valve free plastic bag formed from a tubular plastic foil having a central portion defined transversely by two inner central longitudinal fold edges 4, **4*a* and four outer longitudinal gusset fold edges 2, 3, and 2*a*, 3*a* which bound the gusset fold parts 5, 6 and 5*a* , 6*a* extending from the inner longitudinal folds 4, 4*a*. The bag is open at its top end and has a transverse bottom seal 12. As best seen in FIG. 1, there are two diagonal lower fold part seals 8 and 9, 10 and 11 respectively at each side of the bag near the transverse bottom seal 12. Lower fold part seals 8 and 10 respectively connecting outer foil layer 1*a* with gusset fold parts 6, 6*a* respectively; lower fold part seals 9, 11 respectively connecting outer foil layer 1*b* with gusset fold parts 5, 5*a*** respectively.

Two diagonal upper fold part seals 13 and 14; 15 and 16 are located at the upper end of the bag at both sides thereof. Upper fold part seals 13, 15 respectively connect the outer foil layer **1*a* with an opposite gusset fold part 6, 6*a* respectively; upper fold part seals 14, 16 connect outer foil layer 1*b* with gusset fold parts 5, 5*a* respectively. The upper fold part seals extend in the region between the central fold edges 4, 4*a* and the outer longitudinal fold edges 2, 3 and 2*a*, 3*a*. The bag has at each side near the longitudinal fold edges 4, 4*a* additional seals 30, which extend towards the filling opening 28 of bag 27, which are connected with the upper fold part seals 13, 14, 15 and 16**.

The bag 27 has also additional seals 30 which are connected with the lower fold part seals 8, 9, 10, 11 and extend to the free end of the bag below the transverse bottom seal 12. The seals 30 connected with the lower fold part seals 8, 9, 10, 11 extend above and below the transverse bottom seal 12.

The bag 27 is formed as shown in my U.S. Pat. No. 4,561,107 in a continuous web of bags from which the bag 27 is separated, filled with the desired contents and sealed across the opening.

What is claimed is:

1. A valve free rectangular plastic bag (27), open at one end with gusset folds formed from a tubular foil, at least comprising a central (4, 4*a*) and two outer longitudinal gusset fold edges (2, 3, 2*a*, 3*a*) which bound a first and a second gusset fold part, said bag being open at one end opposite a transverse bottom seal (12) and further comprising:

(a) two lower fold part seals (8, 9, 10, 11) at both sides of the bag, which lower fold part seals always connect an outer foil layer (1*a*, 1*b*) with an opposite gusset fold part (6*a*, 5*a*, 6, 5) said lower fold part seals extending in the region between the central (4, 4*a*) and outer longitudinal fold edges (2, 3; 2*a*, 3*a*) in the region of said transverse bottom seal (12) and diverging from the region of said bottom seal (12) to the outer fold edges (2, 2*a*; 3, 3*a*), (b) upper fold part seals (13, 14, 15, 16) at both sides of the bag which upper foil part seals always connect an outer foil layer (1*a*, 1*b*) with an opposite gusset fold part (6*a*, 5*a*; 6, 5) said upper fold part seals extending in the region between the central (4, 4*a*) and outer longitudinal fold edges (2, 3; 2*a*, 3*a*) at the end of the bag remote from the transverse bottom seal of this bag, said upper fold part seals converging from the outer longitudinal fold edges (2, 3; 2*a*, 3*a*) to the open end of said bag (27) wherein at least at both sides of the bag an additional seal (30) extends substantially parallel to the fold edges and in the region between inner and outer fold edges, said additional seals (30) being at least connected with the upper fold part seals (13, 14; 15, 16) and extending from said upper fold part seals towards the open end of said bag (27), wherein the additional seals (30) extend near the inner fold edges (4, 4*a*), said additional seals (30) allowing to form a closing seal over the whole width of the bag in the region of the open end of the bag said closing seal intersecting the additional seals (30) in the regions of the bag comprising in a flat position of the bag four foil layers (1*a*, 5, 6, 1*b*; 1*a*, 5*a*, 6*a*, 1*b*) and thus the seal portion formed at said intersection being stronger than the same seal portion being formed in the region between the central gusset fold edges (4, 4*a*).

2. A bag according to claim 1 wherein said additional seals extend to the filling opening (28) of said bag.

3. A bag according to claim 1 wherein the additional seals are also connected with the first fold part seals (8, 9, 10, 11) and extend to the free end of the bag below the transverse bottom seal (12).

4. A bag as claimed in claim 1 characterized in that the additional seals (30) connected with the first fold part seals (8, 9, 10, 11) extend above and below the transverse bottom seal (12).

5. A bag as claimed in claim 1 wherein the additional seals (30) which are connected with the free inner end points of the first fold part seals extend beyond the transverse bottom seal (12).

6. A bag as claimed in claim 1 wherein the additional seals (30) connected with the free inner end points of the first part seals extend to the free end of the bag below the transverse bottom seal.

* * * * *